United States Patent [19]

Peter et al.

[11] Patent Number: 4,767,020

[45] Date of Patent: Aug. 30, 1988

[54] METAL TEAR-OPEN LID FOR CANS

[75] Inventors: Wolfgang Peter; Heinz Hacke, both of Cuxhaven, Fed. Rep. of Germany

[73] Assignee: Schmalbach-Lubeca AG, Braunschweig, Fed. Rep. of Germany

[21] Appl. No.: 17,187

[22] Filed: Feb. 19, 1987

[30] Foreign Application Priority Data

Mar. 6, 1986 [DE] Fed. Rep. of Germany ..... 3607402

[51] Int. Cl.[4] ..... B65D 17/34

[52] U.S. Cl. ..... 220/273

[58] Field of Search ..... 220/268–273

[56] References Cited

U.S. PATENT DOCUMENTS

| | | | |
|---|---|---|---|
| 3,752,353 | 8/1973 | Slade | 220/273 |
| 4,524,879 | 6/1985 | Fundom et al. | 220/273 |
| 4,593,834 | 6/1986 | Hoft et al. | 220/273 |

*Primary Examiner*—George T. Hall

*Attorney, Agent, or Firm*—Karl F. Ross; Herbert Dubno

[57] ABSTRACT

There is provided a metal tear-open lid, in particular, made of very thin sheet material wherein by means of a U-shaped recess provided in the tear-open starting section the area where the pull-open ring is fastened to the tear-open portion is reliably prevented from bulging like a membrane as the lid is initially broken up.

5 Claims, 1 Drawing Sheet

METAL TEAR-OPEN LID FOR CANS

FIELD OF THE INVENTION

This invention relates to a metal tear-open lid for cans, in particular, for cans of oblong or rectangular shape and, more specifically, to a lid of the type in which, in the lid plane a tear-open portion having a tear-open starting section is defined by a notched line, and has a lever-type pull-open ring fastened to said tear-open starting section such that its breaking nose is located above the notched line section defining the tear open starting section, the pull-open ring having an end section at the end remote from the breaking nose, and where the tear-open starting section is provided with beads and a recess almost adapted to the shape of the pull-open ring which form a connected stiffening group in the tear-open starting section.

SUMMARY OF THE INVENTION

Numerous embodiments of such lids are known. They may have either a circular, an oblong or a rectangular contour with rounded corners.

In particular, lids of such type are widely employed as lids capable of being fully torn off. In this case, the notched line extends near and almost parallel to the rim of the lid so that most of what also forms part of the can top and is hereinafter referred to as "lid image section" (meaning the outline of the top of the can in the lid plane) is enclosed by the notched line and by removing the tear-open portion substantially the entire cross-section of the can consequently can be exposed. Usually, the tear-open portion comprises a tear-open starting section having a notched line differing in this area from the contour of the lid to define an area confined by a smaller radius of curvature, where the notched line is initially broken for opening. In this area, the pull-open ring which is used for breaking the tear-open portion up and separating the latter from the can is attached for flatwise contact with the tear-open portion mostly by means of a rivet formed out of the lid sheet material.

It is further known to stiffen the lid image section within and outside of the notched line by means of shoulders, stepped areas, ribs or beads. The structural design or orientation of the ribs or beads provided in the tear-open starting section is also known to be different from the design or orientation of the ribs or beads provided in the area of the tear-open starting section which is the last to be separated from the lid image section when the can is opened.

In particular, cans of oblong or rectangular shape are known to have a tear-open starting section which is provided with straight-line or curved beads extending transversely to the longitudinal centerline and, thus, transversely to the tear-open direction. The beads serve to facilitate the sheet rolling operation in the tear-open starting section after the notched line has initially been broken and pulled up and the tear-open portion is subsequently separated from the lid image section and are meant to prevent a barrel-shaped bulging in this area. When the lids are of circular shape, these beads extending transversely to the tear-open direction can be provided up to the end of the tear-open portion. When the lids have an oblong or rectangular contour, however, this bending capacity of the tear-open portion can be eliminated in other regions of the tear-open portion by differently oriented beads. In addition to the transversely extending beads, a recess adapted to the contour of the pull-open ring has already been provided as well in the tear-open starting section, said recess plus the transversely extending beads forming a group of connected beads for stiffening which, additionally, is supplemented by cup-shaped depressed sections provided between the connected stiffening group and the adjacent notched line portions.

The greatest physical effort is known to be required as the notched line is initially torn in the starting section. After the notched line has been torn initially, the force required for continuing the separation along the notched line is substantially reduced even when the tear-open portion needs to be bent or deformed over its entire width.

To resist the comparatively great physical effort required when the notched line is initially torn, the pull-open ring is formed as a rigid lever, in most cases, of thin sheet material and stiffened by means of folded edges or the like. Here, the pull-open ring can be so designed that the point of fastening the pull-open ring to the tear-open portion is rigidly connected to the remaining lever-type body of the pull-open ring. However, the arrangement may be also such that the point of fastening itself is provided in a fastening area adapted to be bent, which is surrounded by the body of the pull-open ring.

In all of these cases, the pull-open ring end requires to be lifted so as to cause the notched line to break by a shearing action. The necessary forces are transmitted from the pull-open ring to the ring body through the fastening rivet and, from the ring body to its breaking nose which is usually located directly above the notched line to force the latter downwardly. As the starting section of the notched line is located near the rim of the lid, this area serves to stiffen the residual part of the lid image section permanently connected to the rim to withstand the pressure of the breaking nose of the lever-type pull-open ring. The notched line is caused to break by the shearing forces provided in this region of the notched line.

In many cases it can be seen that the shearing forces cannot be fully applied to the starting section of the notched line because part of these forces is absorbed by upward deformation which means that the tear-open portion yields like a membrane.

These drawbacks become particularly apparent in cases where a sheet thickness is used which differs from the conventional thicknesses of sheet of 0.24 mm and, consequently, in cases where sheets of a smaller thickness are employed for producing the lid. Due to the fact that the sheet yields on both sides of the rivet, the breaking nose moves beyond the notched line and loses effectiveness. This drawback is aggravated because, by embossing with the notched line, the sheet material become relatively flaccid in this area.

OBJECT OF THE INVENTION

It is an object of the present invention to provide an improved tear-open lid of the type described such that even when thin sheets are employed the shearing forces produced upon lifting of the pull-open ring end section are enabled to have an effect on the initial breaking operation of the notched line below the breaking nose of the pull-open ring substantially more completely and, consequently, more effectively, thereby avoiding the indicated drawbacks.

SUMMARY OF THE INVENTION

This object is achieved by providing the recess below the pull ring of U-shaped configuration comprising legs extending in straight fashion toward the tear-open starting section and parallel to the longitudinal center line of the lid. In the area of the legs, the recess has an approximately trapezoidal cross section. The ends of the transversely extending beads respectively extend up to the notched line sections of the tear-open starting portion until they are spaced therefrom by a distance which almost equals the width of the bead.

In this manner, in particular, when sheets of a minimum thickness are employed a very good stiffening of a confined area of the tear-open starting portion containing the fastening rivet is achieved which largely prevents this area from deforming like a membrane as the pull-open ring end section is lifted for opening the can. The fastening rivet is thus largely maintained in its original position so that the forces exerted through the end section of the pull-open ring have less effect on the deformation of the tear-open starting section but can almost completely be utilized for breaking up the notched line, the nose being maintained in alignment with the notched line. The cross-sectional shape of the recesses and beads, the dimension of the transversely extending beads and the straight extension of the recessed legs contribute substantially to the stabilization of this area.

Advantageously the bead-type recess has its two legs terminating on a line which extends transversely to the longitudinal centerline of the pull-open ring in the form of a tangent to the rivet shank.

Thereby, it is ensured that the decisive, confined area of the tear-open starting section is stiffened to the desired extent and that, at the same time, the required bending of the extreme end of the tear-open starting section is promoted when the notched line is broken. In particular, a great stiffness against torsion is gained by the area in question as well.

Advantageously the recesses projecting toward the bottom lid side and forming part of the group of beads are substantially of equal depth. The web-like portion is shaped like an arc of a circle and extends from one of the transversely extending beads and the transversely extending beads also have a trapezoidal cross-section. The width and/or the depth of the two legs of the U-shaped recess continuously decrease in a direction from said web-type portion toward the free ends of said legs.

To achieve the desired effect, it is above all important that the area of the tear-open starting section which includes the rivet is stiffened in board-type manner so that in this region the membrane-like bulging is largely excluded. On the other hand, the area between the point of fastening and the notched line starting section should be easily bent downwardly to so limit the forces necessary for breaking up.

The area to be bent downwardly is intended to remain confined as accurately as possible to ensure the continuation of a safe breaking up operation of the notched line by applying tensile forces to the pull-open ring. These requirements are met in optimum manner by the beads according to the invention.

BRIEF DESCRIPTION OF THE DRAWING

The invention will hereinafter be described in more detail on the basis of one embodiment and with reference to the accompanying drawing, wherein.

SPECIFIC DESCRIPTION

It is assumed that the lid in question is a lid of oblong shape as is widely employed, for example, in fish cans. However, the lid used may as well be of rectangular or circular shape. The lid is made of sheet material and, preferably, of sheet material having a thickness which is smaller than the usual thickness i.e. less than 0.24 mm.

Figure 1:
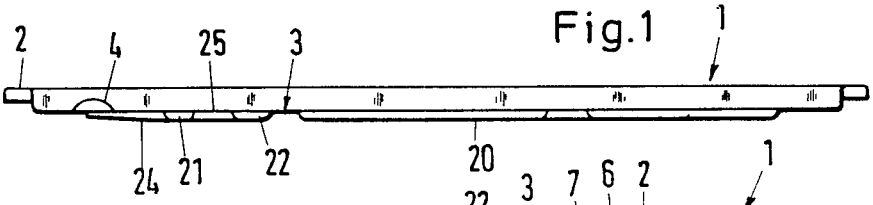
FIG. 1 is a side view of a tear-open lid formed according to the invention.
Figure 2:
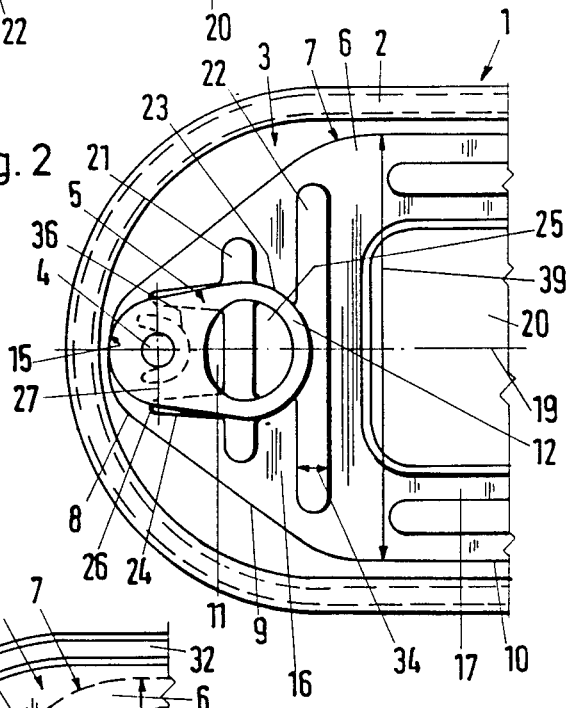
FIG. 2 is a top view of a section of the lid according to to FIG. 1.

As usual, the lid is formed with a folded edge 2 (over the rim of the can) changing into what is referred to as the lid image section 3 or plane. A tear-open portion 6 is defined in the lid image section by a self-contained notched line 7. FIG. 2 substantially only shows the tear-open starting section 16 of the tear-open portion. While notched line 7 extends near the core wall of the lid edge in the remaining area of the lid, its extension deviates from the contour of the lid in the area of the tear-open starting portion 16. Tear-open starting portion 16 is defined by two straight-line sections 9 of the notched line converging towards the left end in FIG. 2 and changing into a relatively tightly curved starting section 8 of the notched line at the end of the lid. By means of rivet 4 formed out of the sheet material a pull-open ring 5 is attached in the area of this end. Said pull-open ring is provided in the form of a rigid lever and, in most cases, is formed out of thin sheet material and is stiffened by rolled edges and the like. In the embodiment shown, the pull-open ring body is directly fastened to the lid sheet for flatwise contact therewith by means of rivet 4. The pull-open ring can also be provided such that the point of fastening is located on a fastening portion of the pull-open ring body defined in FIG. 2 by broken line 36, as is generally known. In the example shown, the longitudinal centerline of the pull-open ring is aligned with the longitudinal center line 19 of the lid having an oblong shape. However, an off-axial orientation of the pull-open ring can also be provided. The pull-open ring has a front end in the form of a breaking nose 15 arranged substantially in alignment with the starting section 8 of the notched line. At the remote end, pull-open ring 5 has a pull-open end section 12 which, in the embodiment shown, is shaped like a ring.

In the further area 17 of the tear-open portion next to the tear-open starting section 16, the sheet is stiffened by means of recess 20 or by means of ribs or beads extending parallel to the lid edge and to the notched line section 10 parallel to the lid edge, respectively. In this area, the width 39 of the tear-open portion almost amounts to the inside width of the can adapted to be closed by the lid.

To counteract the membrane-like bulging of the tear-open starting section as the end section 12 of the pull-open ring 5 is lifted for can opening, a U-shaped bead-like recess 23, 24 is provided near the point of fastening 4 and below the pull-open ring 5. Said recess comprises a web-type portion 23 located below the end section 12 and two legs or arms 24 which project forwardly from the web-type portion towards the notched line starting section 8 and which abruptly terminate at 26 on a common line 28 extending transversely to the longitudinal center line 19 of the pull-open ring 5. Line 28 extends tangentially with respect to the shank 4*a* of rivet 4. Web-type portion 23 is formed in alignment with the pull-open end section 12. If the pull-open end section 12 is shaped like a ring, the web-type portion 23 as well will have a corresponding partial ring-shaped extension, with the width of bead 23 corresponding to ring-shaped end section 12.

In the transition zone to the web-type portion 23 legs 24 may become broader. Their width continuously decreases in direction toward their free ends 26. Their depth can also decrease in this direction. The inner confining sections or flanks 29 of legs 24 extend in straight and parallel manner with respect to line 19. U-shaped recess 23,24 and beads 21, 22 extending transversely to the longitudinal center line of the pull-open ring are combined to form a group of beads. All of the beads of said group of beads substantially are of equal depth. The shorter, transversely extending bead 21 intersects the U-shaped recess at the point of transition between arcuate web 23 and legs 24, while the longer, transversely extending bead 22 touches the ring-shaped web portion 23 as is apparent from FIG. 3. The transversely extending beads 21, 22 formed in a straight line in FIG. 2 can also be slightly curved. A raised portion 25 almost having the area of a semicircle remains within the ring opening of the end section 12 between the transversely extending beads 21, 22. Between the shorter bead 21 and the two legs 24 a plateau-type portion 11 remains in the plane of the lid image section 3, with the fastening rivet for the pull-open ring 4 being provided on said plateau-type portion. Each of the transversely extending beads 21, 22 projects directly up to the adjacent notched line sections 9. The remaining distance 31 corresponds approximately to the width 34 of the beads.

Figure 3:
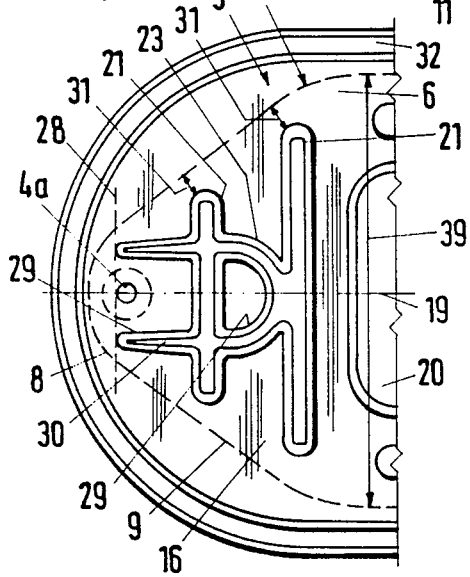
FIG. 3 shows the lid according to FIG. 1 when viewed from the bottom.

The arrangement can be such that by the type of fastening of the pull-open ring 5 or by a slight deformation of said pull-open ring 5 at least part of the end section 12 is caused to at least partly engage the depth of the beads so that by the type of arrangement the pull-open ring is reliably secured against torsion about the point of fastening at the same time. Furthermore, the arrangement and position of the end section 12 with regard to the longer transversely extending bead 22 can be such that it will be easy to move either the finger-nail or the finger-tip under the utmost end of section 12 of the pull-open ring to so lift said end section and open the can. In FIG. 3, reference numeral 32 designates the sealing compound in the folded lid edge 2.

Figure 4:
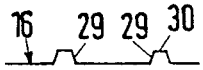
FIG. 4 is a partial cross-section taken transversely to the longitudinal center line of the lid.

At least the legs 24, in the preferred embodiment according to FIG. 3 also the web-type portions 23 and the transversely extending beads 21, 22, have an approximately trapezoidal cross-section as is shown in FIG. 4 at 30.

We claim:

1. A cover for a can comprising:

a lid plane of sheet metal having a thickness of less than 0.24 mm having at least one major axis, and a pair of longitudinal edges and at least one end edge connecting said longitudinal edges, said lid plane being formed with a tear-open portion surrounded by a score line extending along said major axis, and said score line at said tear-open portion including;

two inclined sections converging toward said one end;

a curved starting section joining said inclined sections adjacent said end of said plane; and further sections extending parallel to said longitudinal edges away from said end and respectively adjoining said inclined section, said sections defining a starting part portion of said tear-open portion, said starting part being formed with a plurality of generally linear downwardly projecting beads extending generally transverse to said axis and transversely spaced apart therealong, said linear beads extending toward said inclined sections and terminating at a distance therefrom equal substantially to the widths of said beads, and a U-shaped downwardly projecting bead located symmetrically about said axis, said U-shaped bead intersecting said linear formations, and having:

two legs generally parallel to said axis; and curved webs linking said legs and bridged between said linear beads;

a rivet with a shank on the top of said starting part located at said end, said legs terminating along a line extending perpendicular to said axis and tangential to said shanks; and a pull-ring overlying said beads and connected to said starting part, said pull-ring including:

a portion covering said legs;

a breaking nose lying on said starting part coextensive with said curved portion; and a ring portion connected to said portion covering said legs and shaped to conform to said curved webs.

2. The cover for a can as defined in claim 1 wherein the legs of said U-shaped bead have approximately trapezoidal cross sections.

3. The cover for a can as defined in claim 1 wherein said legs of said U-shaped bead adjoin said curved webs where said webs extend into one of said linear beads.

4. The cover for a can as defined in claim 1 wherein said ring portion is partially received in said curved webs.

5. The cover for a can as defined in claim 1 wherein said legs decrease in width and in height toward said end.

* * * * *